US008433462B2

(12) United States Patent
Miller et al.

(10) Patent No.: US 8,433,462 B2
(45) Date of Patent: Apr. 30, 2013

(54) DRONE VEHICLE

(75) Inventors: Robert S. Miller, Columbia, SC (US); Anthony P. Delucia, Gaston, SC (US); Peter R. Maurice, Irmo, SC (US)

(73) Assignee: Harsco Corporation, Camp Hill, PA (US)

( * ) Notice: Subject to any disclaimer, the term of this patent is extended or adjusted under 35 U.S.C. 154(b) by 392 days.

(21) Appl. No.: 12/827,596

(22) Filed: Jun. 30, 2010

(65) Prior Publication Data

US 2012/0004795 A1 Jan. 5, 2012

(51) Int. Cl.
*G05D 1/00* (2006.01)

(52) U.S. Cl.
USPC ..... 701/19

(58) Field of Classification Search ..... 701/19
See application file for complete search history.

(56) References Cited

U.S. PATENT DOCUMENTS

| | | | | |
|---|---|---|---|---|
| 4,760,797 | A | 8/1988 | Stubbs et al. | |
| 2011/0120342 | A1 * | 5/2011 | Delucia et al. | 105/238.1 |

FOREIGN PATENT DOCUMENTS

| | | | |
|---|---|---|---|
| CA | 2643121 | A1 | 5/2009 |
| DE | 10331063 | A1 | 2/2005 |
| EP | 0397956 | A1 | 11/1990 |
| EP | 0424811 | A1 | 5/1991 |
| FR | 2897326 | A1 | 8/2007 |
| JP | 10266107 | A * | 10/1998 |

OTHER PUBLICATIONS

PCT International Search Report, dated Nov. 2, 2011, 13 pgs.

* cited by examiner

*Primary Examiner* — James Trammell
*Assistant Examiner* — Michael D Lang
(74) *Attorney, Agent, or Firm* — Baker & McKenzie LLP

(57) ABSTRACT

A drone vehicle for performing maintenance on a railway system is provided. A drone vehicle control system is structured to utilize tie position data to position a drone vehicle workhead over at least a portion of a respective tie. The drone vehicle control system is further structured to actuate the drone vehicle workhead. The drone vehicle may be controlled by a drone vehicle control system linked, preferably by wireless communications, to a lead vehicle and a lead vehicle control system. The lead vehicle control system and the drone vehicle control system are structured to communicate with each other, with the lead vehicle control system providing the tie position data to the drone vehicle control system.

20 Claims, 6 Drawing Sheets

DRONE VEHICLE

FIELD OF THE INVENTION

This invention relates to railroad tampers and, more specifically, to a tamping system utilizing a drone tamper that follows a lead tamper.

BACKGROUND OF THE INVENTION

Generally, a railroad includes at least one pair of elongated, substantially parallel rails coupled to a plurality of laterally extending ties which are disposed on a ballast bed. The rails are coupled to the ties by metal tie plates and spikes and/or spring clip fasteners. The ballast is a hard particulate material such as, but not limited to, gravel. Ties may be made from either concrete or wood. The ballast filled space between ties is called a crib. Concrete ties are typically spaced about twenty-four inches apart, whereas wood ties are spaced about nineteen and a half inches apart. However, ties may be "skewed" relative to the rails. That is, the ties may be crooked and not extend generally laterally, i.e. perpendicular to, the rails.

During installation and maintenance of the railroad, the ballast adjacent and/or under the ties must be "tamped," or compressed, to ensure that the ties, and therefore the rails, do not shift. While it is the ballast material that is being tamped, it is common to refer to this operation as tamping a "tie." It is understood that tamping, or otherwise having a tamper assembly engage, a "tie" means that the ballast adjacent/below the indicated tie is being tamped/engaged. As used herein, the tie(s) which are being tamped/engaged shall be identified as a "worksite tie." When the tamper vehicle advances, another tie becomes the "worksite tie."

A tamping device, and/or the vehicle that supports the tamping device, is called a "tamper." As used herein, the vehicle supporting the tamper shall be identified as the "tamper vehicle." The tamper vehicle typically supports at least a pair of tamper assemblies. Each tamper assembly typically consists of one pair of workheads. A workhead includes at least two vibration devices each with a pair of elongated, vertically extending tools structured to move together in a pincer-like motion as well as being structured to move vertically. The vertically extending, and more specifically, vertically descending tool may have a single prong or multiple prongs. A vibration device is coupled to each tool and is structured to vibrate each tool. As the tools are structured to move together in a pincer-like motion, the tools of each of the workheads are disposed on opposite sides of a tamper assembly centerline. In this configuration, a workhead may be disposed above a worksite tie with one or more tools on either side of the rail at the worksite tie.

Because it is desirable to tamp the ballast on both the inner and outer sides of the rail, each of the workheads may have two adjacent pairs of tools; one tool disposed on the outer side of the rail, and one tool disposed on the inner side of the rail. In this configuration, the tools disposed on one side of a worksite tie may share a vibration device.

Thus, a tamper assembly is structured to engage the ballast at eight locations at each worksite tie; one tool set engages the forward side of the tie on the outer side of the rail, one tool set engages the rearward side of the tie on the outer side of the rail, one tool set engages the forward side of the tie on the inner side of the rail, one tool set engages the rearward side of the tie on the inner side of the rail. This is repeated on the tie/rail intersection of the opposite side.

In another configuration, a workhead may be disposed above a rail with one tool set on either side of the worksite at the rail. In this configuration the tools on the outside of the rail are driven by one vibrator, while the tools on the inside of the rail are driven by a separate vibrator. This is also repeated on the tie/rail intersection of the opposite side.

Initially, the tools are generally vertical and parallel to each other. When actuated, each workhead moves vertically downward so that the tips of the tools, that are the lower, distal ends of the prongs, are inserted into the ballast to a predetermined depth. The depth is, preferably, below the bottom of the tie. The tools are then brought together in a pincer-like motion thereby compressing the ballast under the tie. Actuation of the vibration device further compresses the ballast under the tie. Once the vibration operation is complete, the tools are returned to a substantially vertical orientation and lifted out of the ballast. The tamper vehicle then advances to the next worksite tie and the operation is repeated. Typically, a tamping operation lasts about three seconds.

Some tamper vehicles use more than one pair of tamper assemblies. That is, one pair of tamper assemblies is disposed forward but adjacent the other pair of tamper assemblies on the tamper vehicle. When there are two pairs of tamper assemblies, and if one were to alternately identify the ties in a series of ties as being "odd" or "even" ties, one pair of tamper assemblies tamps the "odd" ties and the other pair of tamper assemblies tamps the "even" ties. Thus, multiple ties may be tamped at one time.

Where there are two pairs of tool heads, two configurations are commonly used. In one configuration, as identified above, the two pairs of tamper assemblies are disposed adjacent each other on the same tamper vehicle body. In this configuration, the two pairs of tamper assemblies typically operate on adjacent ties. One problem with this configuration is that when the ties are disposed too close to each other, or when one tie is skewed so that one end of a tie is close to an adjacent tie, the two pairs of tool heads may not fit into the space above the ties. If this happens, the operator must disengage one of the two pairs of tool heads and tamp the ties individually. These problems are typically encountered with wood ties.

In another configuration, the second pair of tool heads is disposed on a "chase" vehicle. The chase vehicle typically does not include various components associated with a complete tamper vehicle, e.g. a tie locator, track lifting devices, lining devices, clamps, reference system. Further, the chase vehicle typically requires its own tamper assembly operator.

SUMMARY OF THE INVENTION

The present concept is an improvement over the prior art and provides for a drone tamper having a control system and at least two tamper assemblies. The pair of tamper assemblies operates as described above. The drone tamper is controlled by a computer system linked, preferably by wireless communications, to a tamper vehicle. The tamper vehicle, and more specifically its control system, locates and tracks the location of ties and communicates this data to the drone control system. The drone control system tracks the location of the longitudinally shifting pair of tamper assemblies. The drone control system then actuates the tamper assemblies when the tool heads are located over a tie that has not been tamped by the tamper vehicle.

One aspect of the invention is directed to a drone vehicle for use with a lead vehicle for performing maintenance on a railway system. The lead vehicle includes a lead vehicle control system which has tie position data communicated thereto. The drone vehicle has a drone vehicle body having a drone vehicle propulsion device, a drone vehicle control system, at least one drone vehicle workhead structured to perform maintenance on the railroad, and a drone vehicle tie locator. The drone vehicle tie locator is in electronic communication with the drone vehicle control system. The lead vehicle control system and the drone vehicle control system are structured to communicate with each other, with the lead vehicle control system providing the tie position data to the drone vehicle control system. The drone vehicle control system is structured to utilize the tie position data to position the drone vehicle workhead over at least a portion of a respective tie. The drone vehicle control system is further structured to actuate the drone vehicle workhead.

Another aspect of the invention is directed to a maintenance vehicle which is structured to operate on a railroad. The railroad has a ballast bed; at least two elongated, generally parallel rails; and a plurality of ties, said ties disposed on said ballast bed, said rails being coupled to each of said plurality of ties. The maintenance vehicle has a lead vehicle and a drone vehicle. The lead vehicle includes a lead vehicle body, a lead vehicle propulsion device, a lead vehicle control system, at least one lead vehicle workhead structured to perform maintenance on the railroad, a lead vehicle tie locator and an associated lead vehicle encoder wheel. The lead vehicle tie locator and the lead vehicle encoder wheel are in electronic communication with the lead vehicle control system. The lead vehicle tie locator and the lead vehicle encoder wheel are structured to create tie position data, with the tie position data being communicated to the lead vehicle control system. The lead vehicle control system is structured to utilize the tie position data to position the lead vehicle workhead over at least a portion of a first respective tie. The lead vehicle control system is further structured to actuate the lead vehicle workhead. The drone vehicle includes a drone vehicle body having a drone vehicle propulsion device, a drone vehicle control system, at least one drone vehicle workhead structured to perform maintenance on the railroad, a drone vehicle tie locator and an associated drone vehicle encoder wheel. The drone vehicle tie locator and the drone vehicle encoder wheel are in electronic communication with the drone vehicle control system. The lead vehicle control system and the drone vehicle control system are structured to communicate with each other, with the lead vehicle control system providing the tie position data to the drone vehicle control system. The drone vehicle control system is structured to utilize the tie position data to position the drone vehicle workhead over at least a portion of a second respective tie. The drone vehicle control system is further structured to actuate the drone vehicle workhead.

Another aspect of the invention is directed to a drone tamper structured to operate with a tamper vehicle on a railroad, the railroad having a ballast bed; at least two elongated, generally parallel rails; and a plurality of ties, said ties disposed on said ballast bed, said rails being coupled to each of said plurality of ties. The tamper vehicle is structured to travel over said rails and includes a body, a propulsion device, a control system, at least one pair of tamper assemblies structured to tamp a tie, a tie locator and an associated encoder wheel. The tamper vehicle tie locator and the tamper vehicle encoder wheel are in electronic communication with the tamper vehicle control system. The tamper vehicle tie locator and associated tamper vehicle encoder wheel are structured to create tie position data, with the tie position data being communicated to the tamper vehicle control system. The tamper vehicle control system is structured to utilize the tie position data to position the tamper vehicle tamper assemblies over at least a portion of the ties. The tamper vehicle control system is further structured to actuate the tamper vehicle tamper assemblies. The drone tamper has a drone vehicle body structured to support at least one pair of tamper assembly workhead. The drone vehicle body is structured to travel over the rails. A propulsion device is coupled to the drone vehicle body and is structured to propel the drone vehicle body. At least one pair of tamper assembly workheads is coupled to the drone vehicle body. The at least one pair of tamper assembly workheads is structured to tamp the ballast. A control system is structured to operate the at least one pair of tamper tool heads.

Another aspect of the invention is directed to a drone tamper structured to operate on a railroad, the railroad having a ballast bed; at least two elongated, generally parallel rails; and a plurality of ties, the ties disposed on the ballast bed, the rails being coupled to each of the plurality of ties. The drone tamper is structured to travel over the rails. The drone tamper has a vehicle body structured to support at least one pair of tamper assembly workheads. The vehicle body is structured to travel over the rails. A propulsion device is coupled to the vehicle body and structured to propel the vehicle body. At least one pair of tamper assembly workheads is coupled to the vehicle body. The at least one pair of tamper assembly workheads is structured to tamp the ballast. A control system is structured to operate the at least one pair of tamper tool heads. A tie locator and an encoder wheel are in electronic communication with the control system, whereby the tie locator and the encoder wheel create tie position data.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE INVENTION

As used herein, a "drone" or "drone vehicle" is a vehicle structured to operate without direct human control.

As used herein, a "worksite tie" is the tie located below a tamper assembly or tamper workhead. Thus, as the rail vehicle moves, different ties each become a "worksite tie" in turn.

As used herein, the "longitudinal" direction of the rail vehicle extends generally parallel to the direction of the rails of the railroad. Thus, the "lateral direction" extends generally perpendicular to the direction of the rails of the railroad.

As used herein, "forward" and "rearward," as well as similar words, relate to the direction a rail vehicle is traveling. These words shall apply to the initial direction the rail vehicle is described as traveling and shall maintain their meaning even if a further description has the rail vehicle reverse direction.

As used herein "rail wheels" are wheels structured to support the weight of a rail vehicle. Other wheels, such as, but not limited to, wheels on a distance encoding device are not rail wheels even if such an encoder wheel travels along a rail.

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two components are coupled so as to move as one while maintaining a constant orientation relative to each other.

Figure 1:
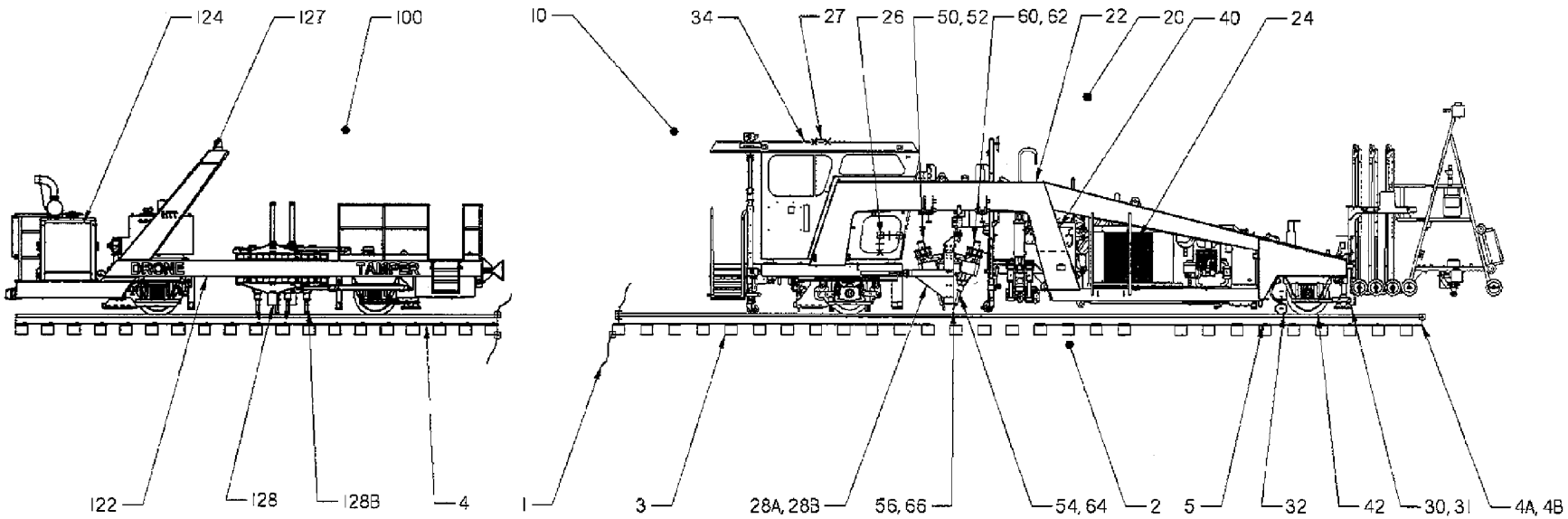
FIG. 1 is a side view of a tamper system.
Figure 3:
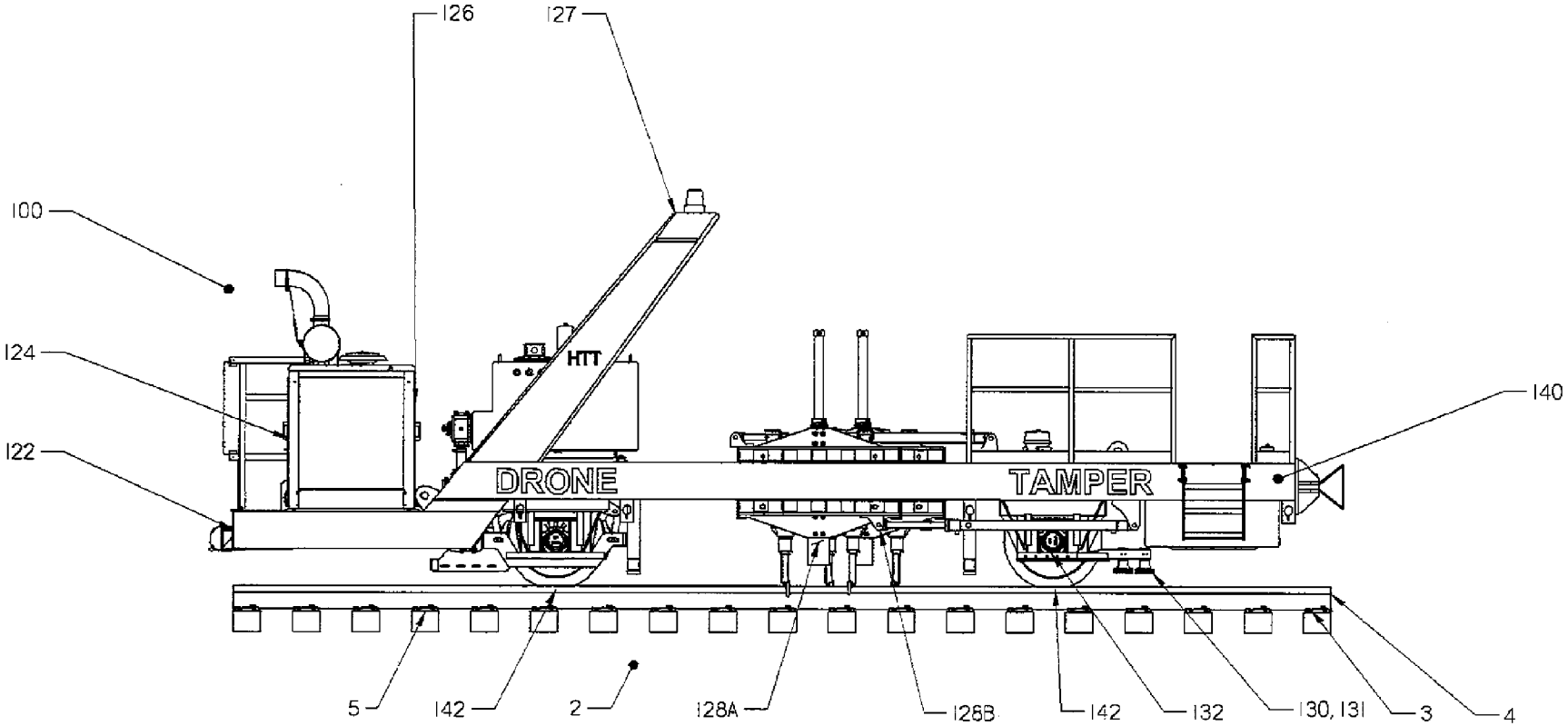
FIG. 3 is a side view of a drone tamper.
Figure 4:
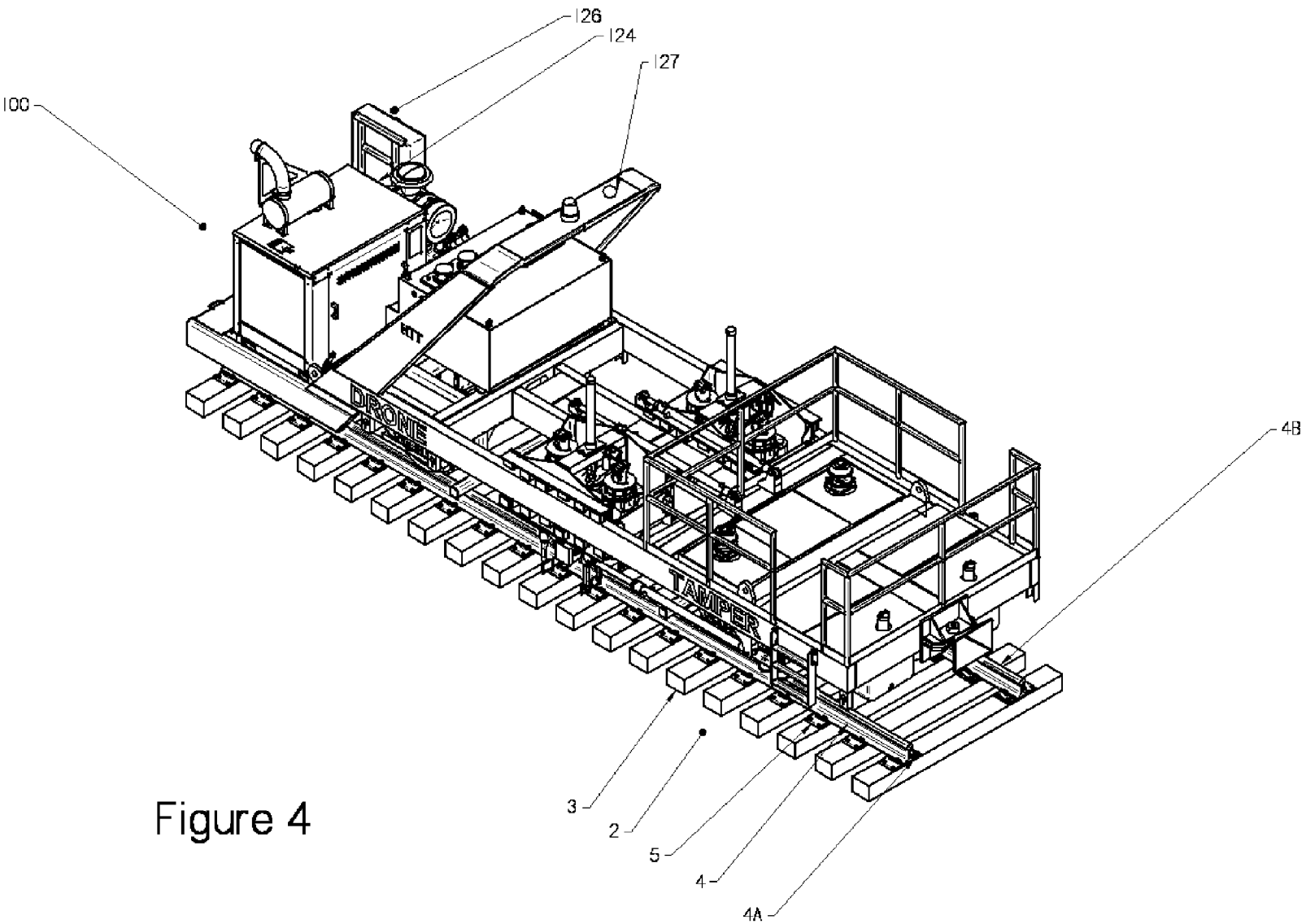
FIG. 4 is an isometric view of a drone tamper.
Figure 5:
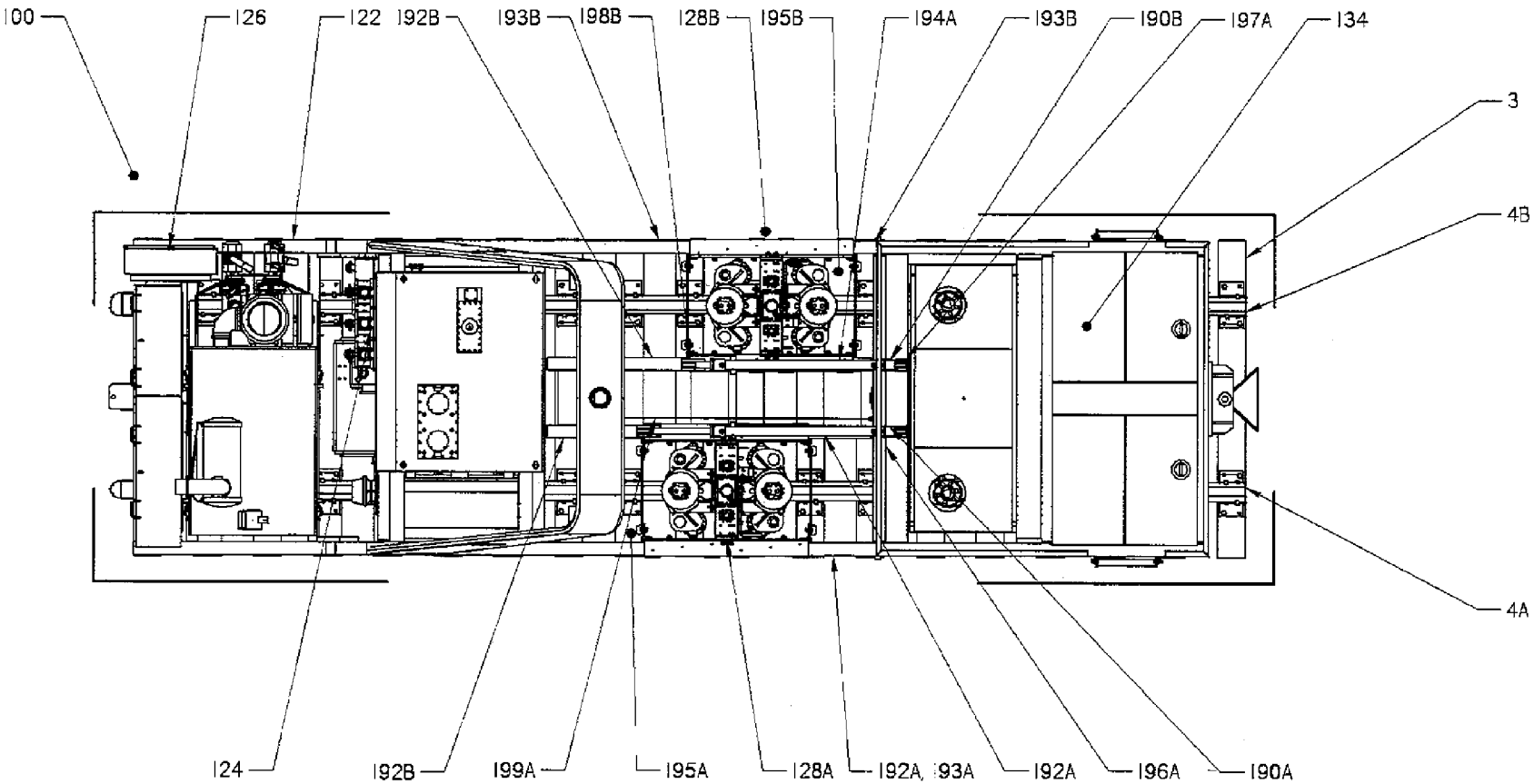
FIG. 5 is a top view of a drone tamper.

As shown in FIG. 1, a railroad 1 includes a ballast 2 substrate, which is typically a hard particulate material such as, but not limited to, gravel. A plurality of substantially parallel, elongated ties 3 are disposed on the ballast. One or more pairs of rails 4 are coupled to the upper side of the ties 3 and extend generally perpendicularly to each tie 3. As is known, the rails 4 are typically coupled to the ties 3 by clips or spikes (not shown). As is further known, a tie plate 5 (FIG. 3) is typically disposed between the tie 3 and the rail 4. The tie plate 5 is typically a metal plate that extends substantially from the forward side of the tie 3 to the rearward side of the tie 3. While it is understood that ties 3 may support any number of rails, only two rails 4, a first rail 4A and a second rail 4B, are shown (FIG. 5). In this configuration both rails 4A, 4B have an "inner" side, i.e. between the rails 4A, 4B, and an "outer" side, i.e. not between the rails 4A, 4B. The convention of "inner" and "outer" sides is applicable to any pair of rails 4, even if there is an adjacent pair of rails 4 on the tie. That is, a location may be on the "outer" side of one pair of rails 4 even if there is a second, adjacent pair of rails 4 and the location is between the first and second pairs of rails.

As shown in FIG. 1, a tamper system 10 includes a tamper vehicle 20 and a drone tamper 100. The tamper vehicle 20 includes a vehicle body 22, a propulsion device 24, a control system 26, at least one pair of tamper assemblies 28 structured to tamp a tie 3, a tie locator 30 with an associated encoder wheel 32, and an operator cabin 34. The tamper vehicle body 22 includes a frame 40 and plurality of rail wheels 42. The tamper vehicle rail wheels 42 are coupled to the tamper vehicle frame 40. The tamper vehicle rail wheels 42 are further structured to travel over the rails 4A, 4B. The tamper vehicle propulsion device 24 is structured to propel the tamper vehicle 20 over the rails 4A, 4B.

The tamper vehicle encoder wheel 32 is fixed to the tamper vehicle body 22 and structured to roll over one rail 4. The tamper vehicle encoder wheel 32 accurately measures the distance the tamper vehicle 20 moves and the speed of the tamper vehicle 20. The tamper vehicle encoder wheel 32 has a known, and fixed, diameter and produces a signal, or known quantity of pulses for each revolution. Thus, by tracking and recording the number of pulses, the distance the tamper vehicle body 22 travels from a known location may be determined. This data is the tamper position data. The distance the tamper vehicle body 22 travels, i.e. distance data, is preferably tracked from a local point at the maintenance/installation site. Further, by comparing the distance traveled to a set period of time, the speed of the tamper vehicle body 22 is known. While the tamper vehicle body 22 is moving forward, the tamper vehicle encoder wheel 32 is turning in a clockwise motion, as shown in the figures. The tamper position data and tamper movement data are converted to an electronic signal and communicated to the tamper vehicle control system 26.

The tie locator 30 is disposed at the forward end of the tamper vehicle 20 and may be disposed on an extension that extends in front of the tamper vehicle body 22. Two tie locators 30 may be positioned on the tamper vehicle 20, with one positioned over each rail 4A and 4B to allow the tie locators to detect if a tie is skewed. Preferably, the tamper vehicle tie locator 30 is at a fixed distance from the tamper vehicle body 22 and more specifically from the tamper vehicle workheads 28. The tamper vehicle tie locator 30 may be any such known device and, typically, is a metal detector 31 structured to detect the metal tie plate 5 disposed between each rail 4A, 4B and each tie 3. As the tie plate 5 typically extends substantially from the forward side of the tie 3 to the rearward side of the tie 3, such a detector 31 will typically record a peak when the detector 31 is over the middle of the tie plate 5 and therefore the tie 3. The tamper vehicle tie locator 30, and/or the detector 31, is structured to produce "tie configuration data" representing the initial detection of the tie plate 5, the peak detection of the tie plate 5, and the final detection of the tie plate 5. The tie configuration data may also include information relating to the spacing between adjacent ties 3 and the tie plates 5 disposed thereon. For example, if a tie 3 is skewed, i.e. one tie plate 5 on the skewed tie 3 is closer to the next tie 3 in the forward direction, information representing the orientation of the skewed tie 3 is included in the tie configuration data. The tie configuration data is converted to an electronic signal and communicated to the tamper vehicle control system 26.

As the distance between the tie locator 30 and the encoder wheel 32 is known, i.e. both are fixed to the tamper vehicle body 22 and the distance there between can be measured, the location of each tie 3, as well as the skew of each tie 3, if any, can be tracked by comparing the tie locator 30 data and the distance data. The data representing the location of each tie 3 is the "tie position data." The tie position data may include the tie configuration data. That is, the tie position data may include data regarding the profile of each tie plate 5 as determined by the detector. The tie position data is maintained in the tamper vehicle control system 26.

The tamper assemblies 28 of the tamper vehicle 20 are similar to the tamper assemblies 128 of the drone tamper 100. The following is a description of a single tamper assembly 28, 128 which may be used on either, or both, the tamper vehicle 20 and/or the drone tamper 100. Further, it is understood that a tamper assembly 28, 128 is typically disposed over each rail 4A, 4B, however, only a single tamper assembly 28, 128 is described below.

Figure 2:
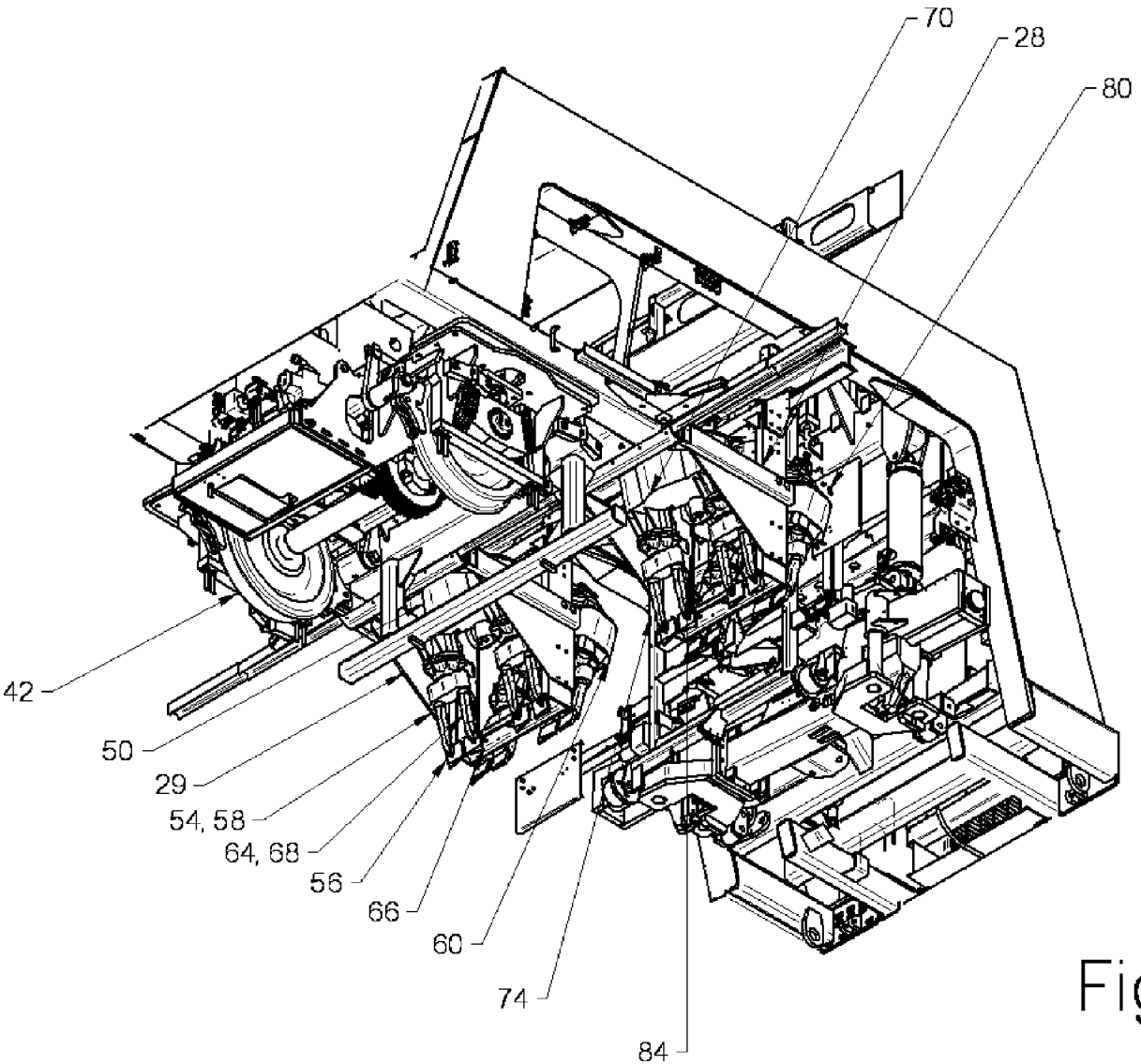
FIG. 2 is an upward isometric view of a lead tamper vehicle.

Each tamper assembly 28, 128 includes at least one pair of tamper assembly workheads 50, 60. As shown in FIG. 2, each workhead 50, 60 includes a vibration device 52, 62 and a pair of elongated, vertically extending tools 54, 64. The vertically extending, and more specifically, vertically descending tools 54, 64 are elongated shafts which may have a single prong (not shown) or multiple prongs 56, 66. The distal ends 58, 68 of the tools 54, 64 are structured to engage and pass into the ballast 2. The tool distal ends 58, 68 may be generally flat plates that extend generally laterally to the rails 4. When coupled to an associated vehicle, tamper vehicle 20 or the drone tamper 100, and in a substantially vertical orientation, the tools 54, 64 are spaced wider than a tie 3 width apart, but not so wide as to be able to engage, i.e. contact, two ties 3 at once. That is, the tools 54, 64 are spaced to engage the ballast 2 on either side of a worksite tie 3 without contacting an adjacent tie 3.

The at least one pair of tamper assembly workheads 50, 60 are movably coupled to the associated vehicle, tamper vehicle 20 or the drone tamper 100, and structured to move vertically. That is, the tamper assembly workheads 50, 60 are structured to move between a first, upper position, wherein the tools 54, 64 do not engage the ballast 2, and a second, lower position, wherein the tools 54, 64 do engage the ballast 2. Preferably, when the workheads 50, 60 are in the second, lower position, the tool distal ends 58, 68, are below the bottom of the worksite tie 3.

The at least one pair of tamper assembly workheads 50, 60 are also structured to move the tools 54, 64 together in a pincer-like motion. Typically, the tamper assembly 28, 128 includes a tamper assembly mount 29 to which the workheads 50, 60 are pivotally coupled. The pivot pin (not shown) for each workhead 50, 60 extends generally laterally relative to the rails 4. In this configuration, the tools 54, 64, and more specifically the tool distal ends 58, 68, are structured to compact ballast 2 below a worksite tie 3. To assist in the compacting of the ballast 2, each extending tool 54, 64 is coupled at least somewhat rigidly to a vibration device 52, 62. When the vibration device 52, 62 is actuated, the tool 54, 64 rapidly vibrates thereby enhancing the compacting action of the pincer-like motion.

While a tamper assembly 28 may function with only a single pair of workheads 50 and 60, it is typical to have two pairs, that is four, workheads 50, 60, 70, 80 per tamper assembly 28, 128. The second pair of workheads 70, 80 include the same components as described above and it is understood that like reference numbers apply. That is, for example, the second pair of workheads 70, 80 includes tools 74, 84. It is noted, however, that the workheads on the same side of the rail, i.e. forward or rearward of the worksite tie and inboard or outboard of the rail may share a vibration device 52, 62 (FIG. 1).

In this configuration, a workhead 50, 60, 70, 80 may be disposed above a worksite tie 3 with one tool 54, 64, 74, 84 on either side of the rail 4 at the worksite tie 3. That is, a first workhead 60 engages the ballast 2 on the forward side of the tie 3 on both sides of the rail 4. The opposing/associated second workhead 50 engages the ballast 2 on the rearward side of the tie 3 on both sides of the rail 4. The third workhead 80 engages the ballast 2 on the forward side of the tie 3 on both sides of the rail 4. The opposing/associated fourth workhead 70 engages the ballast 2 on the rearward side of the tie 3 on both sides of the rail 4.

Each vehicle, the tamper vehicle 20, or the drone tamper 100, preferably, has at least two tamper assemblies 28 with one tamper assembly 28 disposed over each rail 4A, 4B. The tamper assemblies 28 may be identified as tamper vehicle first tamper assembly 28A, tamper vehicle second tamper assembly 28B. As shown, the tamper vehicle first tamper assembly 28A includes workheads 50, 60 and the tamper vehicle second tamper assembly 28B includes workheads 70, 80. Further, and as discussed below, there is also a drone tamper first tamper assembly 128A and a drone tamper second tamper assembly 128B.

The tamper vehicle control system 26 includes one or more programmable logic circuits (not shown) and may be identified colloquially as a "computer." The tamper vehicle control system 26 includes a communication system 27 (shown schematically) that is structured to communicate with the drone tamper communication system 127, discussed below. The tamper vehicle control system 26 is in electronic communication, typically by a hardwire and/or a wireless system, with the tamper vehicle propulsion device 24, the at least one pair of tamper assemblies 28, the tie locator 30 and the encoder wheel 32. That is, the control system 26 sends data, including commands, to and/or receive data from the tamper vehicle propulsion device 24, the at least one pair of tamper assemblies 28, the tie locator 30 and the encoder wheel 32.

In addition to collecting and tracking distance data, movement data, and tie location data, the tamper vehicle control system 26 is structured to control the tamper vehicle propulsion device 24 and the actuation of the tamper vehicle first tamper assembly 28A, tamper vehicle second tamper assembly 28B. Preferably, this operation is generally automatic. That is, based on the tracking distance data, movement data, and tie location data, the tamper vehicle control system 26 may engage the tamper vehicle propulsion device 24 to move the tamper vehicle body 22 into a position so that the tamper vehicle first tamper assembly 28A and tamper vehicle second tamper assembly 28B are disposed over a worksite tie 3. The tamper vehicle control system 26 may then actuate the tamper vehicle first tamper assembly 28A and tamper vehicle second tamper assembly 28B to perform a tamping cycle at the worksite tie 3. A tamping cycle begins when at least one of the tamper vehicle first tamper assembly 28A, 28B is actuated and includes a down thrust of at least one pair of workheads 50 and 60 or 70 and 80 so that the associated tool 54, 64, 74, 84 penetrates the ballast 3, the closing and/or pinching of the at least one pair of workheads 50, 60, 70, 80, the actuation of the vibration device 52, 62, 72, 82 associated with the at least one pair of workheads 50, 60, 70, 80, the return of the at least one pair of workheads 50, 60, 70, 80 to a generally vertical orientation, and the withdrawal, or uptake, of the at least one pair of workheads 50, 60, 70, 80 and associated tool 54, 64, 74, 84, i.e. the uptake of the tamper vehicle first tamper assembly 28A, 28B. Following a tamping cycle, the tamper vehicle control system 26 actuates the propulsion device 24 so as to advance the tamper vehicle 20 until the at least one pair of workheads 50, 60, 70, 80 are positioned over a subsequent worksite tie 3.

The operator cabin 34 is coupled to the tamper vehicle body 22 and includes a control panel (not shown) coupled to the tamper vehicle control system 26. The operator cabin 34, which may be generally open or enclosed, is structured to accommodate one or more human operators. The control panel is structured to communicate, e.g. via displays, gages, meters etc. the condition of the tamper vehicle 20 and the drone tamper 100.

As shown in FIGS. 3-6, the drone tamper 100 includes a vehicle body 122, a propulsion device 124, a control system 126, at least one pair of tamper assemblies 128 structured to tamp a tie 3, and a tie locator 130 with an associated encoder wheel 132. Preferably, the drone tamper vehicle body 122 is not structured to transport a human. The drone tamper body 122 includes a frame 140 and plurality of rail wheels 142. The tamper vehicle rail wheels 142 are coupled to the drone tamper frame 140. The drone tamper rail wheels 142 are further structured to travel over the rails 4A, 4B. The drone tamper propulsion device 124 is structured to propel the drone tamper 100 over the rails 4A, 4B.

The drone tamper encoder wheel 132 is fixed to the drone tamper body 122 and structured to roll over one rail 4 or may be mounted to the idler axle of the drone tamper 100. The drone tamper encoder wheel 132 accurately measures the distance the drone tamper 100 moves and the speed of the drone tamper 100. The drone tamper encoder wheel 132 has a known, and fixed, diameter and produces a known quantity of pulses or other signal for each revolution. Thus, by tracking and recording the number of pulses, the distance the drone tamper body 122 travels from a known location may be determined. This data is the drone position data. The distance the drone tamper body 122 travels, i.e. distance data, is preferably tracked from a local point at the maintenance/installation site. Further, by comparing the distance traveled to a set period of time, the speed of the drone tamper body 122 is known. While the drone tamper body 122 is moving forward, the drone tamper encoder wheel 132 is turning in a clockwise motion, as shown in the figures. The drone position data and drone movement data are converted to an electronic signal and communicated to the drone tamper control system 126.

The drone tamper tie locator 130 is disposed at the forward end of the drone tamper 100 and may be disposed on an extension that extends in front of the drone tamper body 122. Preferably, the drone tamper tie locator 130 is at a fixed distance from the drone tamper body 122 and more specifically from the drone tamper encoder wheel 132. The drone tamper tie locator 130 may be any such known device and, typically, is a metal detector 131 as described above. The drone tamper tie locator 130 also records a peak when the drone tamper detector 131 is over the middle of the tie plate 5 and therefore the tie 3. The drone tamper tie locator 130, and/or the drone tamper detector 131, is structured to produce "tie configuration data" representing the initial detection of the tie plate 5, the peak detection of the tie plate 5, and the final detection of the tie plate 5. This data is converted to an electronic signal and communicated to the drone tamper control system 126.

The drone tamper control system 126 includes a communication system 127 (shown schematically) that is in wireless communication with the tamper vehicle communication system 127. That is, the drone tamper control system 126 and tamper vehicle control system 26 are structured to communicate with each other. The tamper vehicle control system 26 is structured to provide tie position data to the drone tamper control system 126. The drone tamper control system 126 is structured to provide data, generally relating to the condition of the drone tamper 100, e.g. drone position data, drone movement data, configuration of tamper assemblies 128A, 128B, etc., to the tamper vehicle control system 26.

The drone tamper control system 126 is structured to determine the location of the drone tamper 100 by comparing tie position data (which includes tie configuration data) provided by the tamper vehicle control system 26, hereinafter "tamper vehicle tie position data," with the tie position data (which includes tie configuration data) collected by the drone tamper tie locator 130, hereinafter "drone tamper tie position data." That is, because the drone tamper tie locator 130 is substantially similar to the tamper vehicle tie locator 30, the data collected by the tamper vehicle detector 31 and the drone tamper detector 131 should be substantially similar. The tamper vehicle control system 26 will identify a location for a tie 3 having a specific set of tie configuration data. The tamper vehicle control system 26 will also identify a position for that tie 3. When the drone tamper detector 131 detects a tie 3 having a substantially similar set of tie configuration data, the drone tamper control system 126 can determine the location of the drone tamper 100 relative to that tie 3 and, therefore, the location of the drone tamper 100. The drone tamper control system 126 may constantly compare drone tamper tie position data with tamper vehicle tie position data to determine the location of the drone tamper 100 and/or, after the drone tamper control system 126 initially determines its position, the drone tamper control system 126 may utilize the drone tamper movement data to determine the location of the drone tamper 100.

In the embodiment shown, the drone tamper 100 may include a work deck 134 structured to allow a worker to perform maintenance. The work deck 134 is not intended to support a human while the drone tamper 100 is in use. However, in other embodiments, the work deck may be designed to support a human during operation or travel, thereby allowing maintenance to be conducted during use.

Figure 6:
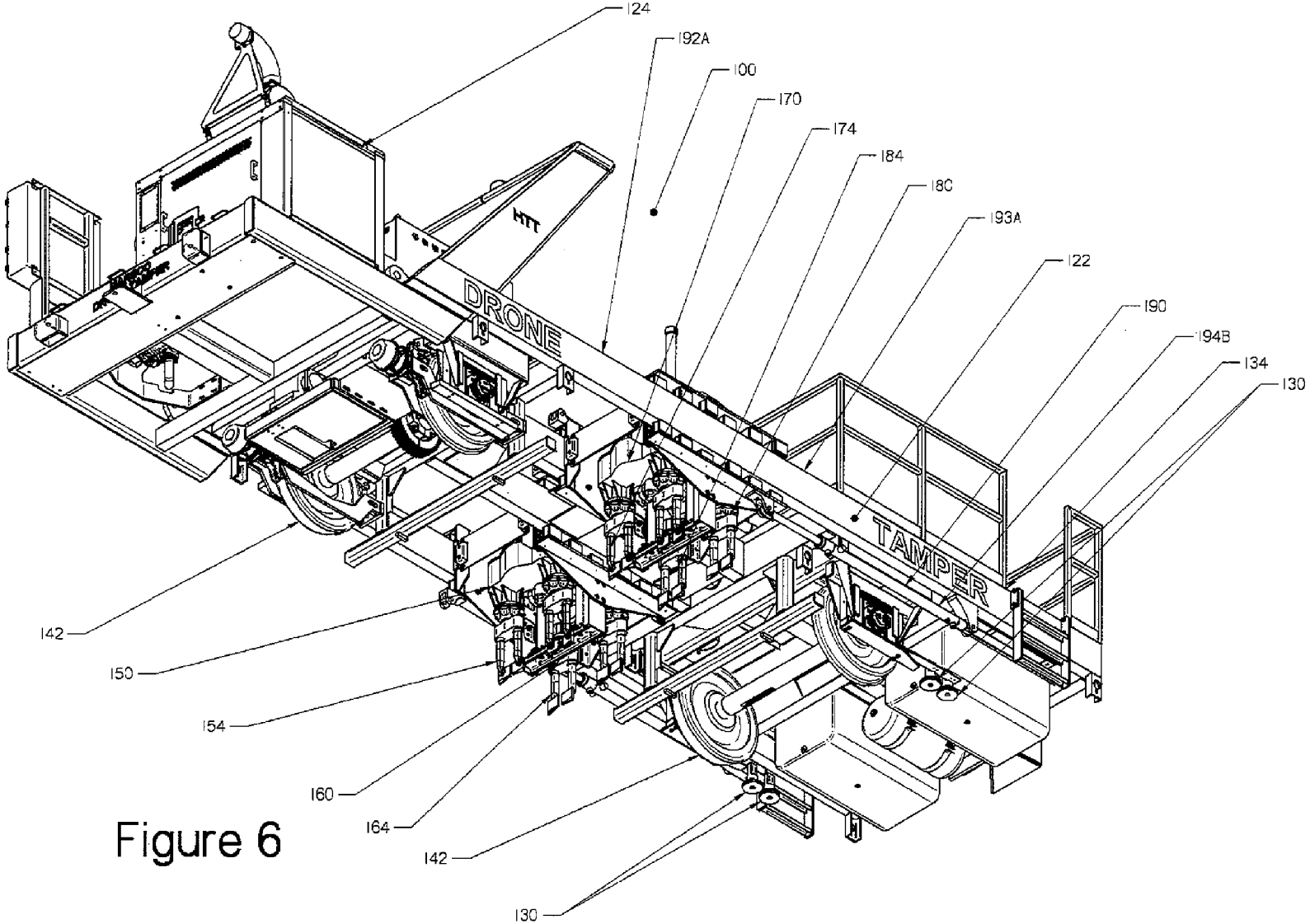
FIG. 6 is an upward isometric view of a drone tamper.

As noted above, the drone tamper 100 include tamper assemblies 128A, 128B that are substantially similar to the tamper vehicle tamper assemblies 28A, 28B. Accordingly, the details regarding the configuration and operation of the drone tamper tamper assemblies 128A, 128B will not be detailed and the above discussion is incorporated by reference. It is noted that the drone tamper tamper assemblies 128A, 128B have the substantially the same components as the tamper vehicle tamper first and second assemblies 28A, 28B. Accordingly, it is understood that a tamper assembly reference number that is increased by "100" refers to a component of the drone tamper tamper assemblies 128A, 128B which is substantially similar to a component on the tamper vehicle tamper assemblies 28A, 28B. For example, as shown in FIG. 6, the drone tamper first tamper assembly 128A includes workheads 170, 180 and the drone tamper second tamper assembly 128B includes workheads 150, 160. These elements are substantially similar to the tamper vehicle tamper first and second assemblies workheads 50, 60, 70, 80, respectively.

The tamper vehicle 20 and/or the drone tamper 100 tamper assemblies 28A, 28B, 128A, 128B may include at least one a longitudinal positioning device 190. This aspect shall be discussed with reference to the drone tamper 100, but it is understood that similar components may be added to the tamper vehicle tamper assemblies 28A, 28B described above. Further, as the drone tamper first and second tamper assemblies 128A, 128B are substantially similar, this aspect shall be described with reference to a single drone tamper tamper assembly, that is the drone tamper first tamper assembly 128A. Again, it is understood that substantially similar components may be included in the drone tamper second tamper assembly 128B and that such components share a similar reference number followed by the letter "B."

The drone tamper first tamper assembly 128A may include a first longitudinal positioning device 190A (FIG. 5). The first longitudinal positioning device 190A is structured to move the drone tamper first tamper assembly 128A longitudinally relative to the drone tamper body 122. The first longitudinal positioning device 190A is structured to move the drone tamper first tamper assembly 128A while the drone tamper body 122 is moving over the rails 4, as described below. The first longitudinal positioning device 190A includes a pair of tamper assembly rails 192A, at least one (two as shown) longitudinal piston(s) 194A, and a control device 196A. The first longitudinal positioning device tamper assembly rails 192A are a pair of elongated beams having an upper bearing surface 193A. The first longitudinal positioning device tamper assembly rails 192A are structured to support the drone tamper first tamper assembly 128A, i.e. at least one of drone tamper assembly workheads 170 or 180, and to allow the drone tamper first tamper assembly 128A to travel longitudinally on the drone tamper body 122.

The drone tamper body 122 includes elongated, longitudinally extending openings 195A, 195B on either side of the first longitudinal positioning device tamper assembly rail 192A. The longitudinal positioning device tamper assembly rails 192A, 192B are disposed on either side of the associated opening 195A, 195B. The drone tamper first tamper assembly workheads 170 and 180 extend through the associated opening 195A. The drone tamper second tamper assembly workheads 150, 160 extend through the associated opening 195B. The drone tamper first tamper assembly 128A is structured to be movably disposed on the first longitudinal positioning device tamper assembly rail bearing surface 193A.

The first longitudinal positioning device longitudinal piston 194A includes an outer cylinder, and a rod coupled to an inner piston member with seals (not shown) disposed within the outer cylinder. As is known, when a fluid is introduced behind the piston member, the first longitudinal positioning device longitudinal piston 194A expands; when the fluid is removed, the first longitudinal positioning device longitudinal piston 194A contracts. The first longitudinal positioning device longitudinal piston 194A has a first end 197A and a second end 198A. The first longitudinal positioning device longitudinal piston first end 197A is coupled to the drone tamper body 122. The first longitudinal positioning device longitudinal piston second end 198A is coupled to the drone tamper first tamper assembly 128A, i.e. at least one of drone tamper assembly 150. As noted above, the first longitudinal positioning device longitudinal piston 194A is structured to expand/contract, that is, move between a first, short configuration and a second, long configuration.

The first longitudinal positioning device control device 196A is structured to control the configuration of the first longitudinal positioning device longitudinal piston 194A. The first longitudinal positioning device control device 196A includes sensors 199A (shown schematically) such as, but not limited to, a string potentiometer, that is structured to indicate the configuration, i.e. position, of the first longitudinal positioning device longitudinal piston 194A. This data is the piston configuration data. The piston configuration data is created as an electronic signal and provided to the first longitudinal positioning device control device 196A. The piston configuration data is used to determine the relative position of the drone tamper first tamper assembly 128A. That is, the piston configuration data is used to determine the longitudinal position of the drone tamper first tamper assembly 128A on the drone tamper body 122. As shown, the first longitudinal positioning device longitudinal piston first end 197A is coupled to the drone tamper body 122 at a location forward of the drone tamper first tamper assembly 128A. Accordingly, when the first longitudinal positioning device longitudinal piston 194A is in the first, short configuration, the drone tamper first tamper assembly 128A is at a forward position relative to the drone tamper body 122. When the first longitudinal positioning device longitudinal piston 194A is in the second, long configuration, the drone tamper first tamper assembly 128A is at a rearward position relative to the drone tamper body 122. It is noted that a single longitudinal positioning device control device 196 may be used to control both the first and second longitudinal positioning device longitudinal pistons 194A, 194B.

The first longitudinal positioning device control device 196A is further structured to receive tie position data from the drone tamper control system 126. The first longitudinal positioning device control device 196A is also structured to receive drone position data and drone movement data from the drone tamper control system 126. The first longitudinal positioning device control device 196A is structured to compare the tie position data, the drone position data, drone movement data and the piston configuration data, so as to determine the position of the drone tamper first tamper assembly 128A relative to a worksite tie 3. It is noted that because drone movement data is included, the first longitudinal positioning device control device 196A is structured to move the drone tamper first tamper assembly 128A while the drone tamper body 122 is in motion. That is, the first longitudinal positioning device control device 196A is structured to maintain the drone tamper first tamper assembly 128A in a substantially stationary location, e.g. above a worksite tie 3, as the drone tamper body 122 is in motion, which is typically a forward motion.

Thus, at the beginning of a tamping cycle, the first longitudinal positioning device longitudinal piston 194A is in the first, short configuration and the drone tamper first tamper assembly 128A is at a forward position relative to the drone tamper body 122. The at least one drone tamper tamper assembly 128A, 128B is then actuated and proceeds through the cycle described above regarding the tamper vehicle first and second tamper assemblies 28A, 28B. While the at least one drone tamper tamper assembly 128A, 128B is being actuated, the drone tamper body 122 is in motion, preferably a forward motion. During the actuation of the at least one drone tamper tamper assembly 128A, 128B, the longitudinal positioning device control device 196 compares the tie location data, the drone position data, drone movement data and the piston configuration data so as to control the expansion of the associated longitudinal positioning device longitudinal piston 194A, 194B toward the second, long configuration, thereby maintaining the at least one drone tamper tamper assembly 128A, 128B in a substantially stationary location, e.g. above a worksite tie 3. That is, generally, the longitudinal positioning device control device 196 causes the associated longitudinal positioning device longitudinal piston 194A, 194B to expand at a rate whereby the at least one drone tamper tamper assembly 128A, 128B moves rearwardly over the associated longitudinal positioning device tamper assembly rails 192A, 192B at substantially the same as the speed as the drone tamper body 122 is moving forward over the rails 4. Thus, the at least one drone tamper tamper assembly 128A, 128B remains in a substantially stationary location, e.g. above a worksite tie 3, during a tamping cycle. Once the tamping cycle is complete, or at least once the associated tools 154, 164, 174, 184 are removed from the ballast 2, the longitudinal positioning device control device 196 rapidly returns the associated longitudinal positioning device longitudinal piston 194A, 194B to the first, short configuration so that the at least one drone tamper tamper assembly 128A, 128B may begin the next tamping cycle.

While the above-described embodiment refers to a tamping vehicle 20 and a drone tamper 100, the invention is directed to any type of track maintenance equipment which has a lead vehicle and one or more drones which follow. As previously discussed, the encoder wheel 32 is fixed to the lead vehicle body 22 and structured to roll over one rail 4. The lead vehicle encoder wheel 32 accurately measures the distance the lead vehicle 20 moves and the speed of the lead vehicle 20. The lead vehicle encoder wheel 32 has a known, and fixed, diameter and produces a signal, or known quantity of pulses, for each revolution. Thus, by tracking and recording the number of pulses, the distance the lead vehicle body 22 travels from a known location may be determined. This data is the "lead position data." The distance the lead vehicle body 22 travels, i.e. distance data, is preferably tracked from a local point at the maintenance/installation site. Further, by comparing the distance traveled to a set period of time, the speed of the lead vehicle body 22 is known. While the lead vehicle body 22 is moving forward, the lead vehicle encoder wheel 32 is turning in a clockwise motion, as shown in the figures. The speed of the lead vehicle body 22, or "lead movement data," is determined either constantly (analog) or, more typically, many times each second (digital). The lead position data and lead movement data are converted to an electronic signal and communicated to the lead vehicle control system 26.

The tie locator 30 is disposed at the forward end of the lead vehicle 20 and may be disposed on an extension that extends in front of the lead vehicle body 22. Two tie locators 30 may be positioned on the lead vehicle 20, with one positioned over each rail to allow the tie locators to detect if a tie is skewed. Preferably, the lead vehicle tie locator 30 is at a fixed distance from the lead vehicle body 22 and more specifically from the lead vehicle workhead 28. The lead vehicle tie locator 30 may be any such known device and, typically, is a metal detector 31 structured to detect the metal tie plate 5 disposed between each rail 4A, 4B and each tie 3. As the tie plate 5 typically extends substantially from the forward side of the tie 3 to the rearward side of the tie 3, such a detector 31 will typically record a peak when the detector 31 is over the middle of the tie plate 5 and therefore the tie 3. The lead vehicle tie locator 30, and/or the detector 31, is structured to produce "tie configuration data" representing the initial detection of the tie plate 5, the peak detection of the tie plate 5, and the final detection of the tie plate 5. The tie configuration data may also include information relating to the spacing between adjacent ties 3 and the tie plates 5 disposed thereon. For example, if a tie 3 is skewed, i.e. one tie plate 5 on the skewed tie 3 is closer to the next tie 3 in the forward direction, information representing the orientation of the skewed tie 3 is included in the tie configuration data. The tie configuration data is converted to an electronic signal and communicated to the lead vehicle control system 26.

As the distance between the tie locator 30 and the encoder wheel 32 is known, i.e. both are fixed to the lead vehicle body 22 and the distance therebetween can be measured, the location of each tie 3, as well as the skew of each tie 3, if any, can be tracked by comparing the tie locator 30 data and the distance data. The data representing the location of each tie 3 is the "tie position data." The tie position data may include the tie configuration data. That is, the tie position data may include data regarding the profile of each tie plate 5 as determined by the detector. The tie position data is maintained in the lead vehicle control system 26.

The lead vehicle control system 26 includes one or more programmable logic circuits (not shown) and may be identified colloquially as a "computer." The lead vehicle control system 26 includes a communication system 27 (shown schematically) that is structured to communicate with the drone communication system 127, discussed below. The lead vehicle control system 26 is in electronic communication, typically by a hardwire and/or a wireless system, with the lead vehicle propulsion device 24, the workhead(s) (which may include, but not be limited to anchor squeezers, spike drivers, track stabilizers, crib booms, tie extractors, single and double brooms, and tampers), the tie locator 30 and the encoder wheel 32. That is, the control system 26 sends data, including commands, to and/or receives data from the lead vehicle propulsion device 24, the workhead(s), the tie locator 30 and the encoder wheel 32.

In addition to collecting and tracking distance data, movement data, and tie location data, the lead vehicle control system 26 is structured to control the lead vehicle propulsion device 24 and the actuation of the lead vehicle workhead(s). Preferably, this operation is generally automatic. That is, based on the tracking distance data, movement data, and tie location data, the lead vehicle control system 26 may engage the lead vehicle propulsion device 24 to move the lead vehicle body 22 into a position so that the workhead(s) is disposed over a worksite tie 3. The lead vehicle control system 26 may then actuate the lead vehicle workhead(s) to perform an appropriate cycle at the worksite tie 3.

The drone encoder wheel 132 is fixed to the drone body 122 and structured to roll over one rail 4. The drone encoder wheel 132 accurately measures the distance the drone vehicle 100 moves and the speed of the drone 100. The drone encoder wheel 132 has a known, and fixed, diameter and produces a known quantity of pulses or other signal for each revolution. Thus, by tracking and recording the number of pulses, the distance the drone body 122 travels from a known location may be determined. This data is the drone position data. The distance the drone body 122 travels, i.e. distance data, is preferably tracked from a local point at the maintenance/installation site. Further, by comparing the distance traveled to a set period of time, the speed of the drone body 122 is known. While the drone body 122 is moving forward, the drone encoder wheel 132 is turning in a clockwise motion, as shown in the figures. The speed of drone body 122, or "drone movement data," is determined either constantly (analog) or, more typically, many times each second (digital). The drone position data and drone movement data are converted to an electronic signal and communicated to the drone control system 126.

The drone tie locator 130 is disposed at the forward end of the drone 100 and may be disposed on an extension that extends in front of the drone body 122. Preferably, the drone tie locator 130 is at a fixed distance from the drone body 122 and more specifically from the drone encoder wheel 132. The drone tie locator 130 may be any such known device and, typically, is a metal detector 131 as described above. The drone tie locator 130 also records a peak when the drone detector 131 is over the middle of the tie plate 5 and therefore the tie 3. The drone tie locator 130, and/or the drone detector 131, is structured to produce "tie configuration data" representing the initial detection of the tie plate 5, the peak detection of the tie plate 5, and the final detection of the tie plate 5. This data is converted to an electronic signal and communicated to the drone tamper control system 126.

The drone control system 126 includes a communication system 127 (shown schematically) that is in wireless communication with the communication system 127. That is, the drone control system 126 and lead vehicle control system 26 are structured to communicate with each other. The lead vehicle control system 26 is structured to provide tie position data to the drone control system 126. The drone control system 126 is structured to provide data, generally relating to the condition of the drone 100, e.g. drone position data, drone movement data, configuration of the drone workheads, etc., to the lead vehicle control system 26. The drone control system 126 is in electronic communication, typically by a hardwire and/or a wireless system, with the drone propulsion device 124, the workheads (which may include, but not be limited to, anchor squeezers, spike drivers, track stabilizers, crib booms, tie extractors, single and double brooms, and tampers), the tie locator 130 and the encoder wheel 132. That is, the control system 126 sends data, including commands, to and/or receives data from the drone propulsion device 124, the workheads, the tie locator 130 and the encoder wheel 132.

The drone control system 126 is structured to determine the location of the drone 100 by comparing tie position data (which includes tie configuration data) provided by the lead vehicle control system 26, hereinafter "lead vehicle tie position data," with the tie position data (which includes tie configuration data) collected by the drone tie locator 130, hereinafter "drone tie position data." That is, because the drone tie locator 130 is substantially similar to the lead vehicle tie locator 30, the data collected by the lead vehicle detector 31 and the drone detector 131 should be substantially similar. The lead vehicle control system 26 will identify a location for a tie 3 having a specific set of tie configuration data. The lead vehicle control system 26 will also identify a position for that tie 3. When the drone detector 131 detects a tie 3 having a substantially similar set of tie configuration data, the drone control system 126 can determine the location of the drone 100 relative to that tie 3 and, therefore, the location of the drone 100. The drone control system 126 may constantly compare drone tie position data with lead vehicle tie position data to determine the location of the drone 100 and/or, after the drone control system 126 initially determines its position, the drone control system 126 may utilize the drone movement data to determine the location of the drone 100.

In addition to collecting and tracking distance data, movement data, and tie location data, the drone control system 126 is structured to control the drone propulsion device 124 and the actuation of the drone workhead(s). Preferably, this operation is generally automatic. That is, based on the tracking distance data, movement data, and tie location data, the drone control system 126 may engage the drone propulsion device 124 to move the drone body 122 into a position so that the workhead(s) is disposed over a worksite tie 3. The drone control system 126 may then actuate the drone workhead(s) to perform an appropriate cycle at the worksite tie 3.

The communication between the control system 26 of the lead vehicle 20 and the control system 126 of the drone 100 is used to instruct the drone 100 to skip ties 3 on which the lead vehicle 20 has previously completed the work (e.g. appropriate squeeze pressure was reach for a tamper assembly of the lead vehicle) and to skip sections of the track which may not be required to be worked on, such as parts of a switch, crossings, etc. In addition, the communication is also used for and during travel of the lead vehicle and the drone(s). It is used to synchronize the encoder wheels at the arrival to the work site and during work cycles to make adjustments to the changing distances resulting from right hand or left hand curves. It is used for programming limits between the lead vehicle and the drone(s), such as, but not limited to: how close the drone can get to the lead vehicle before it should stop working and how far the lead vehicle travels before the drone may resume work. The drone control system communicates the drone position data to the lead vehicle control system. The lead vehicle control system compares the drone position data to the lead vehicle position data and controls the movement of the drone relative to the lead vehicle.

While the above-described embodiment refers to any type of track maintenance equipment which has a lead vehicle and one or more drones which follow, another embodiment is directed to a drone in combination with a gang of other equipment. In this embodiment, no lead vehicle is required and the tie locator is disposed at the forward end of the drone tamper.

The drone encoder wheel 132 is fixed to the drone body 122 and structured to roll over one rail 4. The drone encoder wheel 132 accurately measures the distance the drone vehicle 100 moves and the speed of the drone 100. The drone encoder wheel 132 has a known, and fixed, diameter and produces a known quantity of pulses or other signal for each revolution. Thus, by tracking and recording the number of pulses, the distance the drone body 122 travels from a known location may be determined. This data is the drone position data. The distance the drone body 122 travels, i.e. distance data, is preferably tracked from a local point at the maintenance/installation site. Further, by comparing the distance traveled to a set period of time, the speed of the drone body 122 is known. While the drone body 122 is moving forward, the drone encoder wheel 132 is turning in a clockwise motion, as shown in the figures. The speed of drone body 122, or "drone movement data," is determined either constantly (analog) or, more typically, many times each second (digital). The drone position data and drone movement data are converted to an electronic signal and communicated to the drone control system 126.

The drone tie locator 130 is disposed at the forward end of the drone 100 and may be disposed on an extension that extends in front of the drone body 122. Preferably, the drone tie locator 130 is at a fixed distance from the drone body 122 and more specifically from the drone encoder wheel 132. The drone tie locator 130 may be any such known device and, typically, is a metal detector 131 as described above. The drone tie locator 130 also records a peak when the drone detector 131 is over the middle of the tie plate 5 and therefore the tie 3. The drone tie locator 130, and/or the drone detector 131, is structured to produce "tie configuration data" representing the initial detection of the tie plate 5, the peak detection of the tie plate 5, and the final detection of the tie plate 5. This data is converted to an electronic signal and communicated to the drone tamper control system 126.

The drone tamper control system 126 includes one or more programmable logic circuits (not shown) and may be identified colloquially as a "computer." The drone tamper control system 126 is in electronic communication, typically by a hardwire and/or a wireless system, with the drone tamper propulsion device 124, the workhead(s) (which may include, but not be limited to anchor squeezers, spike drivers, track stabilizers, crib booms, tie extractors, single and double brooms, and tampers), the tie locator 30 and the drone tamper encoder wheel 132. That is, the control system 126 sends data, including commands, to and/or receives data from the drone tamper propulsion device 124, the workhead(s), the tie locator 30 and the drone tamper encoder wheel 132.

In addition to collecting and tracking distance data, movement data, and tie location data, the drone tamper control system 126 is structured to control the drone tamper propulsion device 124 and the actuation of the drone tamper workhead(s). Preferably, this operation is generally automatic. That is, based on the tracking distance data, movement data, and tie location data, the drone tamper control system 126 may engage the drone tamper propulsion device 124 to move the drone tamper vehicle body 122 into a position so that the workhead(s) is disposed over a worksite tie 3. The drone tamper control system 126 may then actuate the drone tamper vehicle workhead(s) to perform an appropriate cycle at the worksite tie 3.

The control system 126 of the drone 100 is may be programmed to instruct the drone 100 to work on any or all of the ties 3, e.g. to skip ties 3 on which the lead vehicle 20 has previously completed the work (e.g. appropriate squeeze pressure was reach for a tamper assembly of the lead vehicle) or to skip sections of the track which may not be required to be worked on, such as parts of a switch, crossings, etc. In addition, the communication is also used for and during travel of the drone(s). It is used to synchronize the encoder wheels at the arrival to the work site and during work cycles to make adjustments to the changing distances resulting from right hand or left hand curves.

The use of the lead vehicle and/or drone(s) has many advantages. As the control systems are automated, the costs associated with operators are greatly reduced. The use of the lead vehicle and/or drone(s) allows the production rate of the overall operation to be increased over the traditional dual or triple headed machines. The use of the lead vehicle and/or drone(s) also allows for more efficient and better quality work to be performed on wood or other ties which are closely spaced or skewed.

With the lead vehicle and drone(s), the vehicles are independent and the design of the vehicles is much simpler than a dual or triple workhead vehicle, thereby reducing the cost of manufacture and maintenance. The separation of the workheads between the lead vehicle and the drone vehicle allows for other operations to be conducted between the workheads as the vehicles operate. As an example, if the lead vehicle is unable to complete its operation because a tie is not properly attached to the rail, the tie may be identified so that workers may manipulate the respective tie prior to the workheads of the drone being positioned over the respective tie, thereby allowing the drone workheads to complete the operation. In addition, as the working components of the lead vehicle and the drone(s) can be identical, the number of parts required in inventory is reduced and the service time is decreased.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention, which is to be given the full breadth of the claims appended and any and all equivalents thereof.

The invention claimed is:

1. A drone vehicle for use with a lead vehicle for performing maintenance on a railroad, the lead vehicle including a lead vehicle control system that has tie position data communicated thereto, the drone vehicle comprising:

a drone vehicle propulsion device;

a drone vehicle control system configured to communicate with the lead vehicle control system, the lead vehicle control system providing the tie position data to the drone vehicle control system;

at least one drone vehicle workhead that performs maintenance on the railroad; and a drone vehicle tie locator configured to electronically communicate with the drone vehicle control system, wherein the drone vehicle control system is configured to utilize the tie position data to position the drone vehicle workhead over at least a portion of a respective tie, and cause the drone vehicle workhead to be actuated.

2. The drone vehicle of claim 1, wherein the drone vehicle includes a drone vehicle encoder wheel, the drone vehicle control system is configured to determine drone position data based on data from the encoder wheel and data from the drone vehicle tie locator, and the drone vehicle control system is configured to communicate the drone position data to the lead vehicle control system.

3. The drone vehicle of claim 1, wherein the drone vehicle control system includes a drone vehicle communication system and a drone vehicle positioning system, the drone vehicle communication system is configured to communicate with the lead vehicle control system to receive the tie position data, the drone vehicle positioning system is configured to track the location of the drone vehicle workhead relative to at least one tie of the railroad, and the drone vehicle control system is configured to compare the location of the drone vehicle workhead relative to the tie position data and to actuate the drone vehicle workhead at a worksite tie.

4. The drone vehicle of claim 3, wherein the drone vehicle workhead moves longitudinally with respect to the drone vehicle.

5. The drone vehicle of claim 4, wherein the drone vehicle includes a drone vehicle body, the drone vehicle body includes at least one longitudinal positioning device, the longitudinal positioning device including an assembly rail, a longitudinal piston, and a control device, the assembly rail supports the drone vehicle workhead and allows the drone vehicle workhead to travel longitudinally on the drone vehicle body, the drone vehicle workhead is movably coupled to the assembly rail, the longitudinal piston extends between a short configuration and a long configuration in a generally longitudinal direction of the drone vehicle body between the drone vehicle body and the drone vehicle workhead, the control device is configured to receive rail position data from the drone vehicle control system and to move the longitudinal piston between the short and long configurations; and the drone vehicle workhead moves longitudinally on the assembly rail between a forward position and a rearward position as the longitudinal piston moves between the short configuration and the long configuration.

6. The drone vehicle of claim 5, wherein the longitudinal piston includes a position sensor configured to detect the configuration of the longitudinal piston and to provide data representing the position of the drone vehicle workhead relative to the drone vehicle body, the longitudinal piston position sensor is configured to communicate with the drone vehicle positioning system, the drone vehicle positioning system is configured to recieve data representing the position of the drone vehicle workhead relative to the drone vehicle body, and combine the data representing the position of the drone vehicle workhead relative to the drone vehicle body with the tie position data, and the drone vehicle control system is configured to actuate the drone vehicle workhead at the worksite tie.

7. The drone vehicle of claim 6, wherein the drone vehicle includes a drone vehicle work assembly that includes at least two pairs of the drone vehicle workheads, and the drone vehicle work assembly performs maintenance on both inner and outer sides of a rail of the railroad.

8. A maintenance system for a railroad, the railroad having a ballast bed, at least two rails, and a plurality of ties disposed on the ballast bed and coupled to the rails, the maintenance system comprising:

a lead vehicle including a lead vehicle propulsion device, at least one lead vehicle workhead that performs maintenance on the railroad, a lead vehicle tie locator, a lead vehicle encoder wheel, and a lead vehicle control system configured to electronically communicate with the lead vehicle tie locator and the lead vehicle encoder wheel, obtain tie position data based on data from the lead vehicle tie locator and the lead vehicle encoder wheel, utilize the tie position data to position the lead vehicle workhead over at least a portion of a first tie, and cause the lead vehicle workhead to be actuated; and a drone vehicle including a drone vehicle propulsion device, at least one drone vehicle workhead that performs maintenance on the railroad, a drone vehicle tie locator, a drone vehicle encoder wheel, and a drone vehicle control system configured to electronically communicate with the drone vehicle tie locator and the drone vehicle encoder wheel, communicate with the lead vehicle control system, receive a data map of tie positions and ties worked by the lead vehicle from the lead vehicle control system, utilize the data map to position the drone vehicle workhead over at least a portion of an unworked tie, and cause the drone vehicle workhead to be actuated.

9. The maintenance system of claim 8, wherein the drone vehicle control system is configured to determine drone position data based on data from the drone vehicle encoder wheel and data from the drone vehicle tie locator, and communicate the drone position data to the lead vehicle control system, and the lead vehicle control system is configured to compare the drone position data to lead position data of the lead vehicle to control movement of the drone vehicle relative to the lead vehicle.

10. The maintenance system of claim 8, wherein the drone vehicle control system includes a drone vehicle communication system and a drone vehicle positioning system, the drone vehicle communication system is configured to communicate with the lead vehicle control system to receive the data map, the drone vehicle positioning system is configured to track the location of the drone vehicle workhead relative to the plurality of ties, and the drone vehicle control system is configured to compare the location of the drone vehicle workhead relative to the tie positions of the data map and to actuate the drone vehicle workhead at a worksite tie.

11. The maintenance system of claim 10, wherein the drone vehicle workhead is a tamper assembly workhead.

12. The maintenance system of claim 11, wherein the tamper assembly workhead moves longitudinally on the drone vehicle body.

13. The maintenance system of claim 12, wherein the drone vehicle includes a drone vehicle body, the drone vehicle body includes at least one longitudinal positioning device, the longitudinal positioning device including a tamper assembly rail, a longitudinal piston, and a control device, the tamper assembly rail supports the tamper assembly workhead and allows the tamper assembly workhead to travel longitudinally on the drone vehicle body, the tamper assembly workhead is movably coupled to the tamper assembly rail, the longitudinal piston extends between a short configuration and a long configuration in a generally longitudinal direction of the drone vehicle body between the drone vehicle body and the tamper assembly workhead, the control device is configured to receive rail position data from the drone vehicle control system and to move the longitudinal piston between the short and long configurations; and the tamper assembly workhead moves longitudinally on the tamper assembly rail between a forward position and a rearward position as the longitudinal piston moves between the short configuration and the long configuration.

14. The maintenance system of claim 13, wherein the longitudinal piston includes a position sensor configured to detect the configuration of the longitudinal piston and to provide data representing the position of the tamper assembly workhead relative to the drone vehicle body, the longitudinal piston position sensor is configured to communicate with the drone vehicle positioning system, the drone vehicle positioning system is configured to receive data representing the position of the tamper assembly workhead relative to the drone vehicle body, and the drone control system is configured to actuate the tamper assembly workhead at a worksite tie.

15. The maintenance system of claim 14, wherein the drone vehicle includes a drone tamper assembly that includes at least two pairs of the tamper assembly workheads, and the drone tamper assembly tamps the ballast on both inner and outer sides of at least one of the rails.

16. The maintenance system of claim 14, wherein the drone vehicle includes a first drone tamper assembly that includes at least two pairs of the tamper assembly workheads and tamps the ballast on both inner and outer sides of a first tie/rail intersection, and the drone vehicle includes a second drone tamper assembly that includes at least two pairs of the tamper assembly workheads and tamps the ballast on both inner and outer sides of a second tie/rail intersection.

17. The maintenance system of claim 14, wherein a first drone tamper assembly and a second drone tamper assembly are longitudinally movable independently of each other.

18. The maintenance system of claim 15, wherein the drone vehicle control system is configured to maintain forward movement of the drone vehicle body during at least one tamping cycle place the longitudinal piston in the short configuration at a beginning of the tamping cycle and extend the longitudinal piston during the tamping cycle, control a speed of the extension of the longitudinal piston so that the tamper assembly workhead moves rearward relative to the drone vehicle body at substantially the same speed as the drone vehicle body is moving forward over the rails and the tamper assembly workhead maintains a substantially stationary position relative to the rails during the tamping cycle.

19. A drone vehicle for performing maintenance on a railroad, the railroad having a ballast bed, at least two rails, and a plurality of ties disposed on the ballast bed and coupled to the rails, the drone vehicle comprising:

a vehicle body that supports at least one workhead;

a propulsion device coupled to the vehicle body that propels the vehicle body along the rails;

a control system configured to operate the at least one workhead; and a tie locator configured to electronically communicate with the control system, wherein the control system is configured to determine tie position data based on data from the tie locator.

20. The drone vehicle of claim 19, wherein the control system includes a positioning system;

the positioning system is configured to track the location of the at least one workhead relative to the plurality of ties; and the control system is configured to actuate the at least one workhead at a worksite tie by comparing the location of the at least one workhead relative to the tie position data.

* * * * *